United States Patent [19]

Schram

[11] Patent Number: 5,053,824

[45] Date of Patent: Oct. 1, 1991

[54] SCAVENGELESS DEVELOPMENT APPARATUS HAVING A DONOR BELT

[75] Inventor: Joseph G. Schram, Liverpool, N.Y.

[73] Assignee: Xerox Corporation, Stamford, Conn.

[21] Appl. No.: 512,295

[22] Filed: Apr. 16, 1990

[51] Int. Cl.[5] ..... G03G 15/06

[52] U.S. Cl. ..... 355/259; 118/653; 355/265

[58] Field of Search ..... 355/245, 247, 248, 249, 355/259, 261; 118/647, 649, 653, 654, 661

[56] References Cited

U.S. PATENT DOCUMENTS

| | | | |
|---|---|---|---|
| 4,057,340 | 11/1977 | Bean | 355/326 |
| 4,370,056 | 1/1983 | Hays | 355/259 X |
| 4,412,733 | 11/1983 | Doutney | 355/251 |
| 4,431,296 | 2/1984 | Haneda et al. | 355/249 |
| 4,459,009 | 7/1984 | Hays et al. | 355/259 |
| 4,618,243 | 10/1986 | Knapp | 355/251 |
| 4,868,600 | 9/1989 | Hays et al. | 355/259 |

OTHER PUBLICATIONS

Xerox Co-pending U.S. Patent Application No. 07/171,062, Applicant Hays et al., Filed Mar. 21, 1988 (copy not available).

Xerox Co-Pending Patent Application No. 07/396,153, Applicant:Folkins, filed Aug. 21, 1989 (copy not available).

*Primary Examiner*—A. T. Grimley

*Assistant Examiner*—J. E. Barlow, Jr.

*Attorney, Agent, or Firm*—H. Fleischer; J. E. Beck; R. Zibelli

[57] ABSTRACT

An apparatus in which an electrostatic latent image recorded on a photoconductive belt is developed with toner. A donor belt is wrapped about a portion of a magnetic roll to define an extended loading zone. The magnetic roll advances a developer material comprising carrier and toner to the loading zone. At the loading zone, toner is deposited on the donor belt. A plurality of electrode wires are positioned in the space between the donor belt and the photoconductive belt. The electrodes are electrically biased to detach the toner from the donor belt so as to form a toner cloud in the space between the electrodes and photoconductive belt. Detached toner from the toner cloud develops the latent image.

16 Claims, 2 Drawing Sheets

SCAVENGELESS DEVELOPMENT APPARATUS HAVING A DONOR BELT

Figure 1:
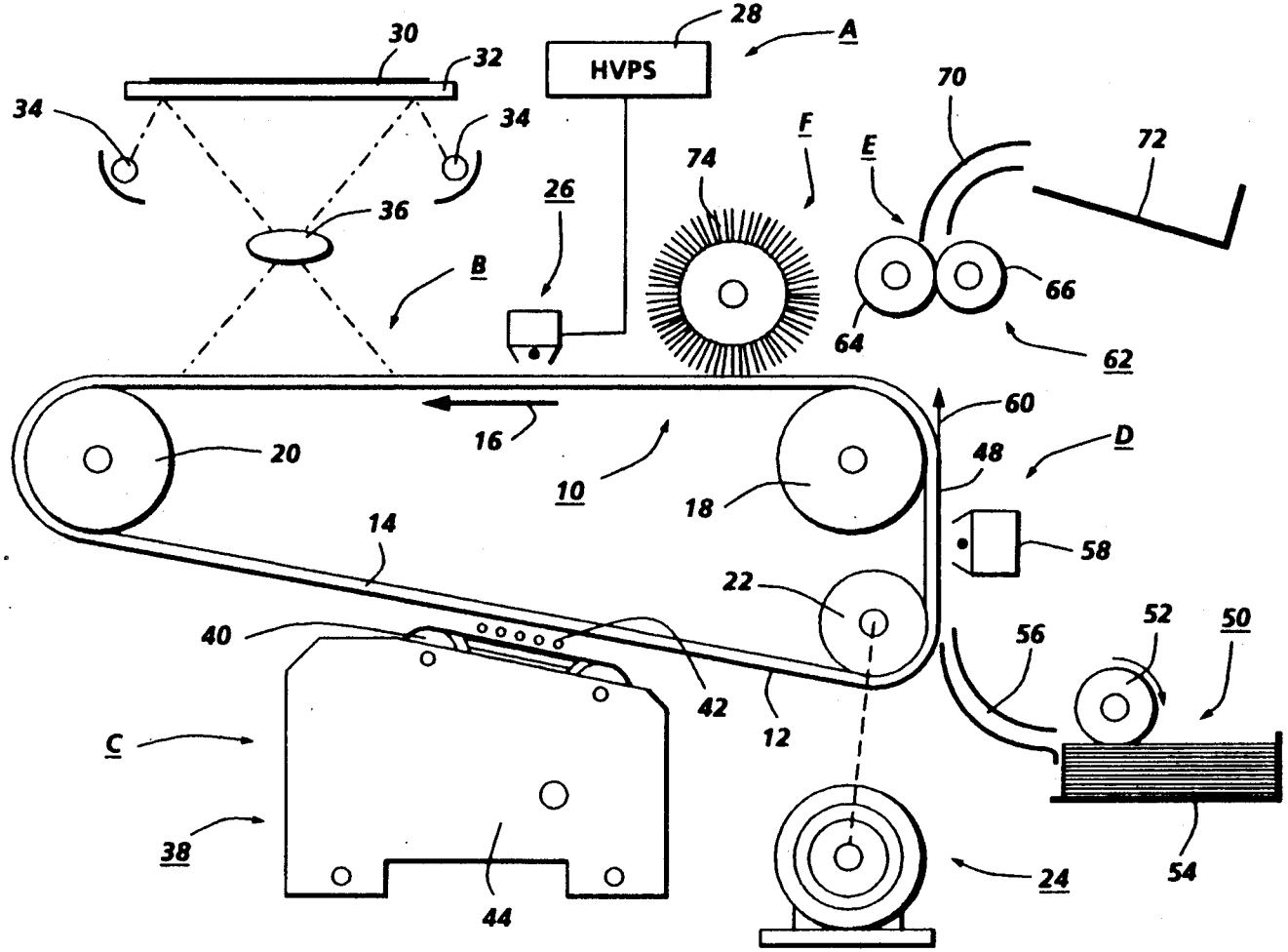

This invention relates generally to an electrophotographic printing machine, and more particularly concerns using a magnetic roll to advance developer material to a donor belt having electrode wires closely spaced therefrom to form a toner cloud in the development zone to develop a latent image.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In jumping development, an AC voltage is applied to the donor roller detaching toner from the donor roll and projecting the toner toward the photoconductive member so that the electrostatic fields generated by the latent image attract the toner to develop the latent image. Single component development systems appear to offer advantages in low cost and design simplicity. However, the achievement of high reliability and easy manufacturability of the system may be present a problem. Two component development systems have been used extensively in many different types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages. Accordingly, it is desirable to combine these systems to form a hybrid development system having the desirable features of each system. For example, at the 2nd International Congress on Advances in Non-impact Printing held in Washington, D.C. on Nov. 4–8, 1984, sponsored by the Society for Photographic Scientists and Engineers, Toshiba described a development system using a donor roll and a magnetic roller. The donor roll and magnetic roller were electrically biased. The magnetic roller transported a two component developer material to the nip defined by the donor roll and magnetic roller. Toner is attracted to the donor roll from the magnetic roll. The donor roll is rotated synchronously with the photoconductive drum with the gap therebetween being about 0.20 millimeters. The large difference in potential between the donor roll and latent image recorded on the photoconductive drum causes the toner to jump across the gap from the donor roll to the latent image so as to develop the latent image. Systems of this type are restricted by the speed of the rolls to deliver limited amounts of toner to the development zone. To close tolerance, in the development zone, of the location of the electrode wires and the critical design of the magnetics is sensitive to speed. Furthermore, the limited dwell time in the development zone reduces image quality. Various other types of development systems have been devised. The following disclosures appear to be relevant:

U.S. Pat. No. 4,057,340
Patentee: Bean
Issued: Nov. 8, 1977

U.S. Pat. No. 4,412,733
Patentee: Doutney
Issued: Nov. 1, 1983

U.S. Pat. No. 4,431,296
Patentee: Haneda et al.
Issued: Feb. 14, 1984

U.S. Pat. No. 4,618,243
Patentee: Knapp
Issued: Oct. 21, 1986

U.S. Pat. No. 4,868,600
Patentee: Hays et al.
Filed: Mar. 21, 1988

Co-pending U.S. patent application No. 07/396,153
Applicant: Folkins
Filed: Aug. 21, 1989

The relevant portions of the foregoing disclosures may be briefly summarized as follows:

U.S. Pat. No. 4,057,340 discloses a plurality of rolls mounted on a rotating support. Each roll attracts toner to the surface thereof and when positioned adjacent the development zone by rotation of the support deposits toner on a latent image.

U.S. Pat. No. 4,412,733 describes a web wrapped about a portion of a photoconductive drum. The web is supported by spaced rollers. Magnets are located behind the web in the region adjacent the photoconductive drum. The web transports developer material to the development zone.

U.S. Pat. No. 4,431,296 discloses a pair of rollers positioned adjacent a photoconductive drum. The developer roller transports the toner to the nip between the rollers. The rollers are electrically biased relative to one another to form a toner powder cloud which develops the latent image recorded on the photoconductive drum.

U.S. Pat. No. 4,618,243 describes a paddle wheel transporting developer material to a developer roll. A photoconductive belt is entrained about a portion of the developer roll defining an extended development zone. The developer roll advances the developer material to the development zone to develop the latent image recorded on the photoconductive belt.

Co-pending U.S. patent application Ser. No. 07/171,062 now U.S. Pat. No. 4,868,600 and Co-pending U.S. patent application Ser. No. 07/396,153 disclose a scavengeless development system in which a donor roll has toner deposited thereon. A pair of electrode wires are closely spaced to the donor roll in the gap between the donor roll and the photoconductive member. An AC voltage is applied to the electrode wires to detach toner from the doner roll and form a toner powder cloud in the gap. Toner from the toner power cloud is attracted to the latent image recorded on the photoconductive member to develop the latent image recorded thereon. A magnetic brush roll is used with two component developer for depositing the toner layer onto the donor roll.

In accordance with one aspect of the present invention, there is provided an apparatus for developing a latent image recorded on a surface. The apparatus includes a housing defining a chamber storing a supply of developer material comprising at least carrier and toner therein. A donor belt, spaced from the surface, is adapted to transport toner to a region opposed from the surface. Means are provided for advancing developer material in the chamber of the housing to the donor belt. The donor belt is wrapped about a portion of the advancing means to define an extended loading zone where toner is deposited on the donor belt. An electrode member is positioned in the space between the surface and the donor belt. The electrode member is closely spaced from the donor belt and electrically biased to detach toner from the donor belt. The detached toner forms a toner cloud in the space between the electrode member and the surface with detached toner from the toner cloud developing the latent image.

Pursuant to another aspect of the present invention, there is provided an electrophotographing printing machine of the type in which an electrostatic latent image recorded on a photoconductive belt is developed to form a visible image thereof. The improvement includes a housing defining a chamber storing a supply of developer material comprising at least carrier and toner. A donor belt, spaced from the photoconductive member, is adapted to transport toner to a region opposed from the photoconductive member. Means are provided for advancing developer material in the chamber of the housing to the donor belt. The donor belt is wrapped about a portion of the advancing means to define an extended loading zone where toner is deposited on the donor belt. An electrode member is positioned in the space between the photoconductive member and the donor belt. The electrode member is closely spaced from the donor belt and electrically biased to detach toner from the donor belt. The detached toner forms a toner cloud in the space between the electrode member and the photoconductive member with detached toner from the toner cloud developing the electrostatic latent image recorded on the photoconductive member.

Figure 2:
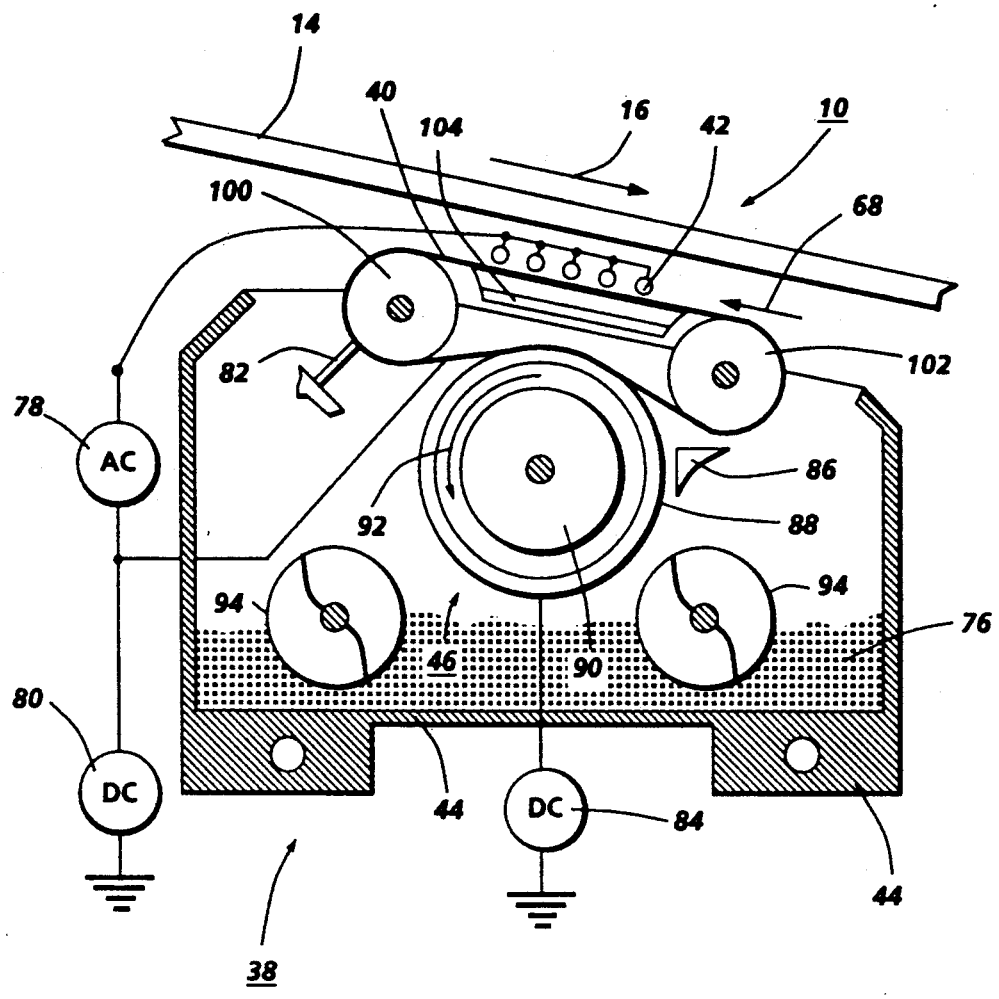

Other features of the present invention will become apparent as the following description proceeds and upon reference to the drawings, in which:

FIG. 1 is a schematic elevational view of an illustrative electrophotographic printing machine incorporating a development apparatus having the features of the present invention therein; and FIG. 2 is a schematic elevational view showing the development apparatus used in the FIG. 1 printing machine.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system, indicated generally by the reference numeral 38, develops the latent image recorded on the photoconductive surface. Preferably, development system 38 includes donor belt 40 and electrode wires 42. Electrode wires 42 are electrically biased relative to donor belt 40 to detach toner therefrom so as to form a toner powder cloud in the gap between the donor belt and photoconductive surface. The latent image attracts toner particles from the toner powder cloud forming a toner powder image thereon. Donor belt 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller disposed interiorly of the chamber of housing 44 conveys the developer material to the donor belt. The magnetic roller is electrically biased relative to the donor belt so that the toner particles are attracted from the magnetic roller to the donor belt. The development apparatus will be discussed hereinafter, in greater detail, with reference to FIG. 2.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging style.

It is believed that the foregoing description is sufficient for purposes of the present application to illustrate the general operation of an electrophotographic printing machine incorporating the development apparatus of the present invention therein.

Referring now to FIG. 2, there is shown development system 38 in greater detail. As shown thereat, development system 38 includes a housing 44 defining a chamber 76 for storing a supply of developer material therein. Donor belt 40, electrode wires 42 and magnetic roller 46 are mounted in chamber 76 of housing 44. The donor belt can be moved in either the 'with' or 'against' direction relative to the direction of motion of belt 10. In FIG. 2, donor belt 40 is shown moving in the direction of arrow 68, i.e. the against direction. Similarly, the magnetic roller can be rotated in either the 'with' or 'against' direction relative to the direction of motion of belt 10. In FIG. 2, magnetic roller 46 is shown rotating in the direction of arrow 92 i.e. the against direction. Donor belt 40 has a ground plane on the inside. When an insulative substrate is used, the substrate is thin, i.e. about 5 millimeters thick and a ground brush must be located after cleaing blade 82 to erase any residual charge on donor belt 40. Preferably, the substrate is made from a semiconductive material which will bleed charge from the belt surface and provide a close "image charge" for electrode wires 42 to provide a large electric field. If the ground plane is outside, rollers 100 and 102 can not supply the electrical bias and a separate biasing ontact or brush is required. Donor belt 40 is entrained about a pair of spaced rollers 100 and 102. Rollers 100 and 102 are electrically conductive. A platen 104 supports belt 40 and maintains it substantially flat in the region opposed from belt 10 defining a development zone. Donor belt 40 is wrapped about magnetic transport roll 46 to define an extended loading zone.

Development system 38 also has a plurality of electrode wires 42 which are disposed in the spaced between the belt 10 and donor belt 40. Five electrode wires are shown extending in a direction substantially parallel to donor belt 40. The electrode wires are made from tungsten or stainless steel wires (i.e. about 0.002 inches in diameter) which are closely spaced from donor belt 40. The distance between the wires and the donor belt is approximately 25$\mu$ or the thickness of the toner layer on the donor belt. The wires are self-spaced from the donor belt by the thickness of the toner on the donor belt.

As illustrated in FIG. 2, an alternating electrical bias is applied to the electrode wires by an AC voltage source 78. The applied AC establishes an alternating electrostatic field between the wires and the donor belt which is effective in detaching toner from the surface of the donor belt and forming a toner cloud about the wires, the height of the cloud being such as not to be substantially in contact with the belt 10. The magnitude of the AC voltage is in the order of 300 to 600 volts peak at a frequency ranging from about 6 kHz. A DC voltage source 80 applies approximately 300 volts to donor belt 40 to establish an electrostatic field between photoconductive surface 12 of belt 10 and donor belt 40 for attracting the detached toner particles from the cloud surrounding the wires to the latent image recorded on the photoconductive surface. At a spacing ranging from about 10$\mu$ to about 40$\mu$ between the electrode wires and donor belt, an applied voltage of 300 to 600 volts produces a relatively large electrostatic field without risk of air breakdown. The use of a dielectric coating on either the electrode wires helps to prevent shorting of the applied AC voltage. A cleaning blade 82 strips all of the toner from donor belt 40 after development so that magnetic roller 46 meters fresh toner to a clean donor belt. Magnetic roller 46 meters a constant quantity of toner having a substantially constant charge on to donor belt 40. This insures that the donor belt provides a constant amount of toner having a substantially constant charge in the development zone. In lieu of using a cleaning blade, the combination of donor belt spacing, i.e. spacing between the donor belt and the magnetic roller, the compressed pile height of the developer material on the magnetic roller, and the magnetic properties of the magnetic roller in conjunction with the use of a conductive, magnetic developer material achieves the deposition of a constant quantity of toner having a substantially constant change on the donor belt. A DC bias supply 84 which applies approximately 100 volts to magnetic roller 46 establishes an electrostatic field between magnetic roller 46 and donor belt 40 so that an electrostatic field is established between the donor belt and the magnetic roller which causes toner particles to be attracted from the magnetic roller to the donor belt. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the loading zone defined by that portion of donor belt 40 wrapped about magnetic roller 46. Toner particles are attracted from the carrier granules on the magnetic roller to the donor belt.

With continued reference to FIG. 2, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferromagnetic core having a thin layer of magnetite overcoated with a non-continuous layer of resinous material. The toner particles are made from a resinous material, such as a vinyl polymer, mixed with a coloring material, such as chromogen black. The developer material comprise from about 95% to about 99% by weight of carrier and from 5% to about 1% by weight of toner. However, one skilled in the art will recognize that any suitable developer material having at least carrier granules and toner particles may be used.

One skilled in the art will appreciate that the features of the present invention may be used in a jumping development system. In jumping development, an AC voltage is applied to the donor belt detaching toner from the donor belt and projecting the toner toward the photoconductive belt so that the electrostatic field generated by the latent image attracts the toner to develop the latent image.

In recapitulation, it is evident that the development apparatus of the present invention includes electrode wires positioned closely adjacent the exterior surface of a donor belt and being in the gap between the donor belt and the photoconductive member. A magnetic roller receives magnetic two component developer material. The magnetic roller and the donor belt are electrically biased relative to one another so that a constant quantity of toner particles having a substantially constant triboelectric charge is deposited on the donor belt. The donor belt is wrapped about a portion of the magnetic roller. An AC voltage is applied to the electrode wires to detach toner particles from the donor belt so that a toner powder cloud is formed in the gap between the photoconductive member and the donor belt. Detached toner particles from the toner powder cloud are attracted to the latent image recorded on the photoconductive member to develop the latent image.

It is, therefore, apparent that there has been provided in accordance with the present invention, a development system that fully satisfies the aims and advantages hereinbefore set forth. While this invention has been described in conjunction with a specific embodiment thereof it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a surface having a planar portion, including:

a housing defining a chamber storing a supply of developer material comprising at least carrier and toner;

a donor belt having a substantially planar region opposed and spaced from the planar portion of the surface, said donor belt being adapted to transport toner to the region opposed from the planar portion of the surface;

an electrode member positioned in the space between the planar portion of the surface and the planar region of said donor belt, said electrode member being closely spaced from the planar region of said donor belt and being electrically biased to detach toner from said donor belt so as to form a toner cloud in the space between said electrode member and the planar portion of the surface with detached toner from the toner cloud developing the latent image; and means for advancing developer material in the chamber of said housing to said donor belt, said donor belt being wrapped about a portion of said advancing means to define an extended loading zone where toner is deposited on said donor belt.

2. An apparatus according to claim 1, further including means for electrically biasing said donor belt and said advancing means relative to one another so as to deposit toner on said donor belt.

3. An apparatus according to claim 2, further including means for supporting said donor belt so as to maintain the region thereof opposed from the surface substantially planar.

4. An apparatus according to claim 3, further including means for removing the developer material from said donor belt after development of the latent image.

5. An apparatus according to claim 4, wherein the developer material in the chamber of said housing is magnetic.

6. An apparatus according to claim 5, wherein said advancing means includes means for attracting magnetically developer material from the supply thereof in the chamber of said housing to the exterior surface thereof.

7. An apparatus according to claim 6, wherein said attracting means includes:

a non-magnetic tubular member mounted rotatably so as to advance developer material from the chamber of said housing to said donor member; and an elongated magnetic member disposed interiorly of said tubular member for attracting developer material to the surface of sai tubular member.

8. An apparatus according to claim 7, wherein said electrode member includes a plurality of small diameter wires.

9. An electrophotographic printing machine of the type in which an electrostatic latent image recorded on a photoconductive belt having a planar portion is developed to form a visible image thereof, wherein the improvement includes:

a housing defining a chamber storing a supply of developer material comprising at least carrier and toner;

a donor belt having a substantially planar region opposed and spaced from the planar portion of the photoconductive belt, said donor belt being adapted to transport toner to the region opposed from the planar portion of the photoconductive belt;

an electrode member positioned in the space between the planar portion of the photoconductive belt and the planar region of said donor belt, said electrode member being closely spaced from the planar region of said donor belt and being electrically biased to detach toner from said donor belt so as to form a toner cloud in the space between said electrode member and the planar portion of the photoconductive belt with detached toner from the toner cloud developing the latent image; and means for advancing developer material in the chamber of said housing to said donor belt, said donor belt being wrapped about a portion of said advancing means to define an extended loading zone where toner is deposited on siad donor belt.

10. A printing machine according to claim 9, further including means for electrically biasing said donor belt and said advancing means relative to one another so as to deposit toner on said donor belt.

11. A printing machine according to claim 10, further including means for supporting said donor belt so as to maintain the region thereof opposed from the photoconductive belt substantially planar.

12. A printing machine according to claim 11, further including means for removing the developer material from said donor belt after development of the latent image.

13. A printing machine according to claim 12, wherein the developer material in the chamber of said housing is magnetic.

14. A printing machine according to claim 13, wherein said advancing means includes means for attaching magnetically developer material from the supply thereof in the chamber of said housing to the exterior surface thereof.

15. A printing machine according to claim 14, wherein said attracting means includes:

a non-magnetic tubular member mounted rotatably so as to advance developer material from the chamber of said housing to said donor belt; and an elongated magnetic member disposed interiorly of said tubular member for attracting developer material to the surface of said tubular member.

16. A printing machine according to claim 15, wherein said electrode member includes a plurality of small diameter wires.

* * * * *